US009410734B2

(12) United States Patent
Shin et al.

(10) Patent No.: US 9,410,734 B2
(45) Date of Patent: Aug. 9, 2016

(54) REFRIGERATOR

(71) Applicant: LG ELECTRONICS INC., Seoul (KR)

(72) Inventors: Dong Hun Shin, Kyungsangnam-do (KR); Scott Kim, Kyungsangnam-do (KR); Chang Bong Choi, Kyungsangnam-do (KR); Seong Taik Kim, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/439,443

(22) PCT Filed: Oct. 29, 2013

(86) PCT No.: PCT/KR2013/009674

§ 371 (c)(1),
(2) Date: Apr. 29, 2015

(87) PCT Pub. No.: WO2014/069872

PCT Pub. Date: May 8, 2014

(65) Prior Publication Data

US 2015/0292795 A1 Oct. 15, 2015

(30) Foreign Application Priority Data

Oct. 29, 2012 (KR) ..... 10-2012-0120684

(51) Int. Cl.
*F25D 27/00* (2006.01)
*F25D 25/02* (2006.01)
(Continued)

(52) U.S. Cl.
CPC ..... *F25D 27/00* (2013.01); *F25D 23/00* (2013.01); *F25D 23/028* (2013.01); *F25D 25/02* (2013.01)

(58) Field of Classification Search
CPC ..... F25D 27/00; F25D 2327/00; F25D 23/00; F25D 25/02; F25D 2325/022; F25D 23/02; F21V 33/0044; F21V 23/02
See application file for complete search history.

(56) References Cited

U.S. PATENT DOCUMENTS 5,987,199 A * 11/1999 Zarian ..... B26D 3/06 362/559
6,123,431 A * 9/2000 Teragaki ..... G02B 6/0036 362/333

(Continued)

FOREIGN PATENT DOCUMENTS

CN 1576761 2/2005
CN 102032746 4/2011

(Continued)

OTHER PUBLICATIONS

International Search Report dated Feb. 21, 2014 for Application No. PCT/KR2013/009674, 2 pages.

(Continued)

*Primary Examiner* — Daniel Rohrhoff
(74) *Attorney, Agent, or Firm* — Fish & Richardson P.C.

(57) ABSTRACT

Provided is a refrigerator. The refrigerator includes a main body, a door, a shelf, a light source unit, and a light-guiding member. The main body includes a storage compartment. The door opens and closes the storage compartment. The shelf is detachably coupled to the storage compartment to partition the storage compartment into a plurality of spaces. The light source unit illuminates the storage compartment. The light-guiding member is disposed on at least one end of the shelf. Here, the light source unit is disposed such that a portion of light generated in the light source unit enters the light-guiding member.

16 Claims, 8 Drawing Sheets

(51) Int. Cl.
*F25D 23/00* (2006.01)
*F25D 23/02* (2006.01)

(56) References Cited

U.S. PATENT DOCUMENTS

| | | | | |
|---|---|---|---|---|
| 6,210,013 | B1 * | 4/2001 | Bousfield | F25D 27/00 362/218 |
| 7,413,321 | B2 * | 8/2008 | Kim | G09F 13/18 362/127 |
| 2003/0038571 | A1 * | 2/2003 | Obrock | C03B 23/033 312/408 |
| 2003/0072147 | A1 * | 4/2003 | Pashley | A47F 3/0482 362/92 |
| 2004/0062031 | A1 * | 4/2004 | Pinter | A47B 96/02 362/612 |
| 2004/0264160 | A1 * | 12/2004 | Bienick | A47B 97/00 362/602 |
| 2007/0127229 | A1 * | 6/2007 | Lee | F25D 25/02 362/92 |
| 2008/0236183 | A1 * | 10/2008 | Iimura | F25D 25/02 62/264 |
| 2009/0021927 | A1 * | 1/2009 | Hall | F25D 27/00 362/92 |
| 2011/0174012 | A1 | 7/2011 | Park | |
| 2011/0203302 | A1 * | 8/2011 | Alberghetti | F21V 23/02 62/264 |
| 2012/0043338 | A1 * | 2/2012 | Yang | F25D 25/02 220/592.02 |
| 2012/0106129 | A1 * | 5/2012 | Glovatsky | A47F 3/001 362/92 |
| 2012/0140440 | A1 * | 6/2012 | Dam | F21V 23/02 362/92 |
| 2013/0088136 | A1 * | 4/2013 | Bassi | F25D 25/02 312/408 |
| 2014/0268862 | A1 * | 9/2014 | Gooden | F25D 27/00 362/555 |
| 2015/0023000 | A1 * | 1/2015 | Kendall | F25D 25/02 362/92 |

FOREIGN PATENT DOCUMENTS

| | | | |
|---|---|---|---|
| CN | 102410694 | | 4/2012 |
| CN | 202470582 | | 10/2012 |
| DE | 102011054761 | | 5/2012 |
| EP | 2098140 | | 9/2009 |
| EP | 2168461 | | 3/2010 |
| JP | 2000-258051 | | 9/2000 |
| JP | 2008-070079 | A | 3/2008 |
| KR | 10-2012-0052983 | A | 5/2012 |
| NL | 1022656 | | 8/2004 |
| WO | 97/26573 | | 7/1997 |
| WO | 2007/136170 | | 11/2007 |
| WO | WO 2008/089810 | A2 | 7/2008 |
| WO | WO 2011/019589 | A1 | 2/2011 |

OTHER PUBLICATIONS

Office Action issued in Chinese Application No. 201380056704.4 on Jan. 4, 2016, 19 pages (with English translation).
Extended European Search Report issued in European Application No. 13851943.4 on May 24, 2016, 8 pages.

* cited by examiner

REFRIGERATOR

CROSS REFERENCE TO RELATED APPLICATIONS

This application is a U.S. National Phase Application under 35 U.S.C. §371 of International Application PCT/KR2013/009674, filed on Oct. 29, 2013, which claims the benefit of Korean Application No. 10-2012-0120684, filed on Oct. 29, 2012, the entire contents of which are hereby incorporated by reference in their entireties.

TECHNICAL FIELD

The present invention relates to a refrigerator, and more particularly, to a refrigerator provided with a light source unit that can illuminate a storage compartment.

BACKGROUND ART

Generally, a refrigerator, which is an apparatus that stores products such as food at a low temperature by cooling a storage compartment, includes at least one shelf disposed in the storage compartment for efficient utilization of the storage space.

The shelf may be horizontally disposed in the storage compartment. When the arrangement height of the shelf is adjustable, the storage space can be more efficiently utilized.

The refrigerator may include a shelf holder that can fix the shelf and adjust the height of the shelf in the storage compartment.

The refrigerator may include a light source unit that illuminates the storage compartment. The light source unit may be turned on to illuminate the storage compartment when a door is opened, and may be turned off when the door is closed.

DISCLOSURE OF INVENTION

Technical Problem

In a typical refrigerator, since a light-guiding member needs to be longitudinally disposed in forward and backward directions of a shelf, the light-guiding member is large in size and complicated in structure.

The present invention provides a refrigerator, which can maximize the illumination effect for the front side of a shelf while minimizing the size and material cost of a light-guiding member and is simple in structure of the shelf.

Solution to Problem

According to an aspect of the present invention, there is provided a refrigerator comprising: a main body comprising a storage compartment; a door opening and closing the storage compartment; a shelf detachably coupled to the storage compartment to partition the storage compartment into a plurality of spaces; a light source unit illuminating the storage compartment; and a light-guiding member disposed on at least one end of the shelf, wherein the light source unit is disposed such that a portion of light generated in the light source unit enters the light-guiding member.

The main body may include an inner case defining the storage compartment, and the light source unit may be disposed on one surface of the inner case so as to face at least one region of the light-guiding member.

The shelf may be horizontally disposed in the storage compartment, and the light source unit may be disposed on the one surface of the inner case perpendicular to the shelf.

The light-guiding member may be disposed to surround at least a portion of an edge of the shelf.

The light-guiding member may be disposed at a side of an edge of the shelf which faces the door.

The light-guiding member may include a light receiving part for receiving light at one end thereof, and the light source unit may be disposed adjacent to the light receiving part.

The inner case may further include a shelf holder to which the shelf is detachably coupled.

The light-guiding member may be longitudinally disposed at one end of the shelf in left and right directions, and the light source unit may be longitudinally disposed at left and right side plates of the inner case in a vertical direction, respectively.

The light source unit may include a substrate and a plurality of light emitting diodes disposed at different heights, and the number of light emitting diodes may be larger than the number of the light-guiding members.

A portion of the plurality of light emitting diodes may irradiate light to the light-guiding member at the same height as the light-guiding member, and the other light emitting diodes may irradiate light to the storage compartment at heights different from the light-guiding member.

The light source unit may further include an illumination cover that protects the substrate and the light emitting diodes and is exposed to the storage compartment.

The illumination cover may have at least a portion thereof protruding toward the storage compartment compared to an inner surface of the inner case.

The illumination cover may include a first region that faces the light-guiding member in a horizontal direction and a second region that does not faces the light-guiding member in a horizontal direction.

The light source unit may be disposed in plurality to be spaced from each other across the light-guiding member.

The refrigerator may further include a front decoration at a side of the light-guiding member which faces the door.

The light source unit may have a width of forward and backward directions greater than a sum of a width of the light-guiding member in forward and backward directions and a width of the front decoration in forward and backward directions.

The storage compartment may be divided into an internal rear space and an internal front space in which one end of the shelf is disposed, and the light-guiding member may be disposed in the internal front space of the storage compartment.

The light-guiding member may include a scattering agent formed on a rear surface thereof, and may include a decoration pattern formed on a front surface thereof.

The foregoing and other objects, features, aspects and advantages of the present invention will become more apparent from the following detailed description of the present invention when taken in conjunction with the accompanying drawings.

BEST MODE FOR CARRYING OUT THE INVENTION

Hereinafter, exemplary embodiments of the present invention will be described in detail with reference to the accompanying drawings.

Figure 1:
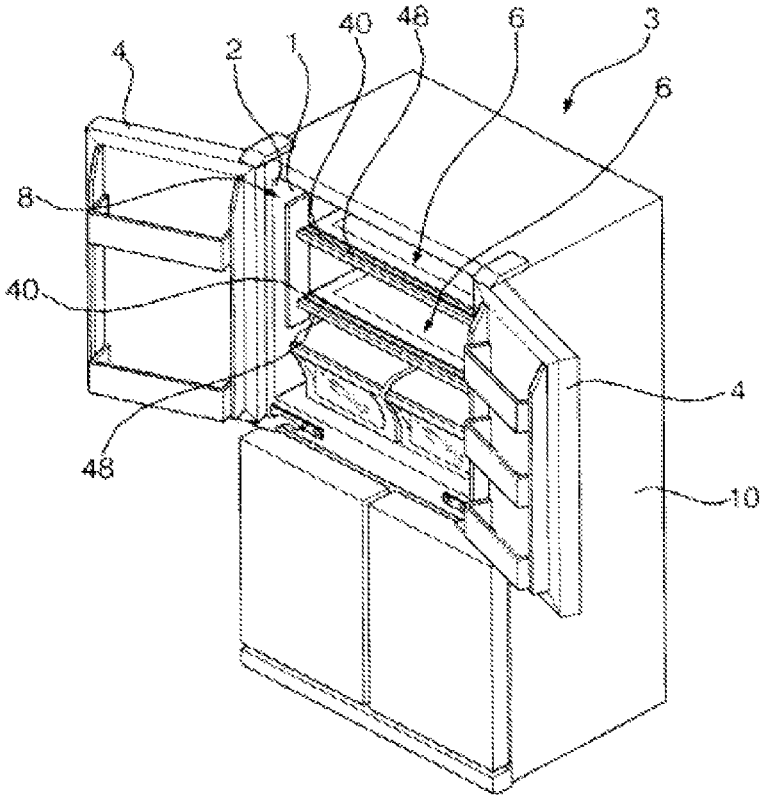
FIG. 1 is a perspective view illustrating an exemplary refrigerator with doors opened according to an embodiment of the present invention.
Figure 2:
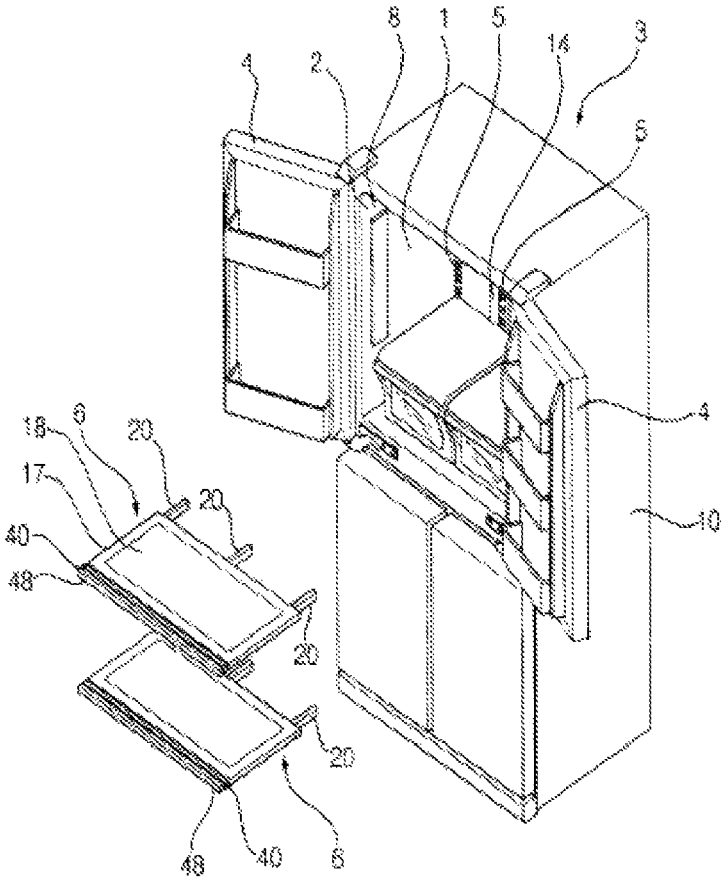
FIG. 2 is a perspective view illustrating an exemplary refrigerator with doors opened and shelves detached according to an embodiment of the present invention.
Figure 3:
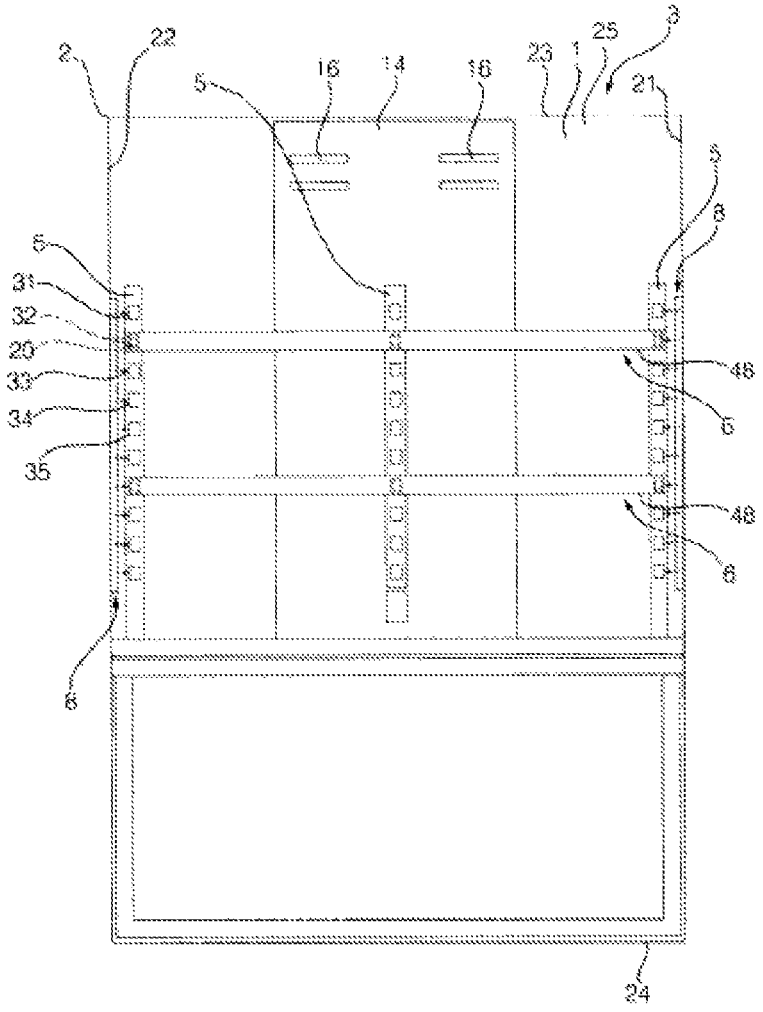
FIG. 3 is a front view illustrating a storage compartment of an exemplary refrigerator with doors opened according to an embodiment of the present invention.
Figure 4:
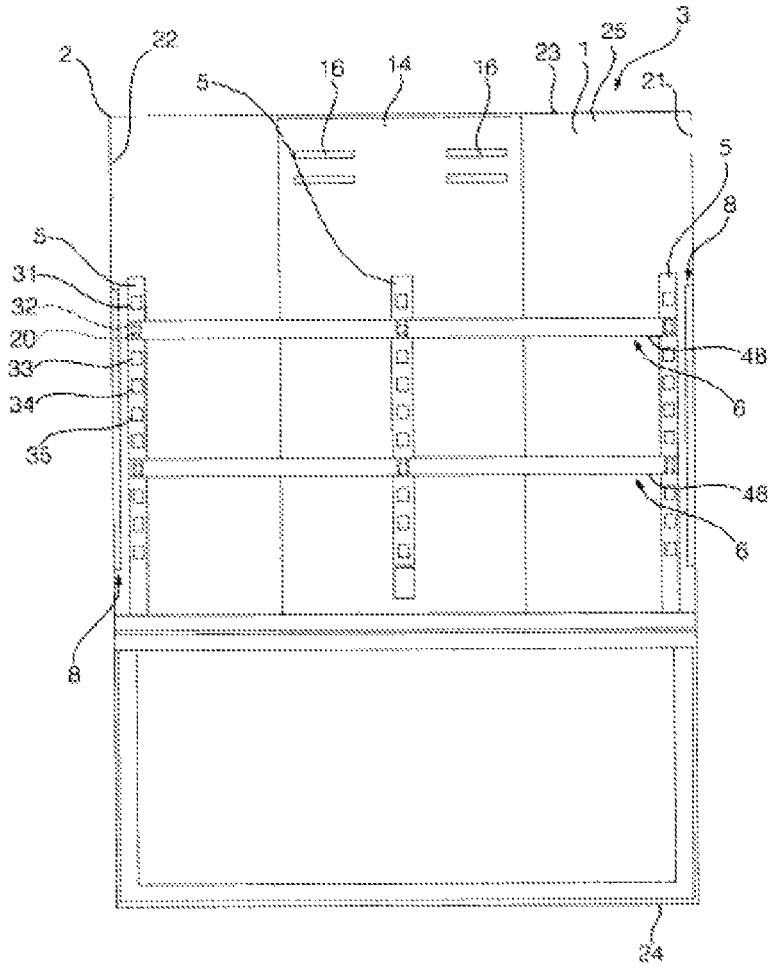
FIG. 4 is a front view illustrating a state of a storage compartment when light is not irradiated from a light source unit of FIG. 2.

FIG. 1 is a perspective view illustrating an exemplary refrigerator with doors opened according to an embodiment of the present invention. FIG. 2 is a perspective view illustrating an exemplary refrigerator with doors opened and shelves detached according to an embodiment of the present invention. FIG. 3 is a front view illustrating a storage compartment of an exemplary refrigerator with doors opened according to an embodiment of the present invention. FIG. 4 is a front view illustrating a state of a storage compartment when light is not irradiated from a light source unit of FIG. 2.

The refrigerator may include a main body including a storage compartment 1, a door 4 for opening/closing the storage compartment 1, a shelf 6 detachably disposed in the storage compartment 1 to partition the storage compartment 1 into a plurality of spaces, and a light source unit 8 illustrating the storage compartment 1.

The main body 3 may include at least one storage compartment 1 formed therein. When a plurality of storage compartments 1 are formed in the main body 3, the plurality of storage compartments 1 may be partitioned by a barrier. The main body 3 may include an upper storage compartment or a lower storage compartment, or may include a left storage compartment and a right storage compartment. The main body 3 may include a refrigeration compartment located at an upper side of the main body 3 and a freezer compartment located under the refrigeration compartment.

The main body 3 may include an outer case 10 defining the exterior of the main body 3.

The storage compartment 1 may be formed in the main body 3. Specifically, the main body 3 may include an inner case 2 defining the storage compartment 1.

The inner case 2 may be located inside the outer case 10. The main body 3 may include an insulating material disposed between the outer case 10 and the inner case 2.

The inner case 2 may have a box shape with the front side opened.

The main body 3 may include a cooling apparatus that cools the storage compartment 1.

The cooling apparatus may include a compressor that compresses a refrigerant, a condenser in which the refrigerant compressed in the compressor is condensed, an expansion device in which refrigerant condensed in the condenser is expanded, and an evaporator in which refrigerant expanded in the expansion device is evaporated.

The main body 3 may include a storage compartment fan (not shown) that blows cold air of the storage compartment 1 to the evaporator and then supplies cold air into the storage compartment 1. The main body 3 may include a cold air duct 14 that guides air cooled by the evaporator to the storage compartment 1. The cold air duct 14 may include a cold air outlet 16 that discharges guided cold air into the storage compartment 1.

One or more doors 4 may be disposed to open and close the storage compartment 1. The door 4 and the main body 3 may include a door sensor device (not shown) such as a door switch, which senses the opening/closing of the door 4.

The shelf 6 may be disposed to support products such as food to be stored in the storage compartment 1, and one or more shelves 6 may be disposed to partition the storage compartment 1 into a plurality of spaces.

The shelf 6 may be horizontally disposed in the storage compartment 1. One or more shelves 6 may be disposed in one storage compartment 1 to be vertically spaced from each other. The shelf 6 may have a rectangular shape as a whole.

The shelf 6 may be detachably disposed in the storage compartment 1.

Specifically, the inner case 2 may include a shelf holder 5 which the shelf 6 is attached to and detached from, and the shelf 6 may be detachably coupled to the shelf holder 5.

For example, the shelf holder 5 may include a plurality of coupling holes 31, 32, 33, 34 and 35 to which the shelf 6 is selectively and detachably coupled.

The shelf holder 5 may be horizontally disposed in the main body 3, and the plurality of coupling holes 31, 32, 33, 34 and 35 may be disposed spaced from each other in forward and backward directions or in left and right directions.

The shelf holder 5 may be longitudinally disposed in the main body 3, and the plurality of coupling holes 31, 32, 33, 34 and 35 may be disposed spaced from each other in a vertical direction. The shelf holder 5 may fix a plurality of shelves 6. The number of coupling holes 31, 32, 33, 34, 35 may be greater than the number of shelves 6 installed at the shelf holder 5. The shelf holder 5 may be disposed in plurality in the main body 3. One shelf holder 5 may fix one shelf 6. One shelf holder 5 may fix a plurality of shelves 6. A plurality of shelf holders 5 may fix one shelf 6. A plurality of shelf holders 5 may fix a plurality of shelves 6.

The shelf 6 may include a fixing part that is a structure for fixing the location thereof. The fixing part may include a fixing pin 20 that is protrusively disposed on the shelf 6. The fixing pin 20 may be protrusively disposed on the shelf 6.

The fixing pin 20 may be a fixing member that fixes the shelf 6 to the shelf holder 5 by hanging the shelf 6 on the shelf holder 5. The fixing pin 20 may protrude toward the rear side of the shelf 6, or may protrude at least in one direction of left and right.

The fixing pin 20 may be integrally formed on the shelf 6, or may be manufactured separately from the shelf 6 and then may be coupled to the shelf 6. The fixing pin 20 may be rotatably or straightly-movably disposed on the shelf 6.

The shelf 6 may include a frame 17 and a plate 18 that is installed in the frame 17 and is transparent or semitransparent. The fixing pin 20 may integrally protrude from one of the frame 17 and the plate 18, or may be coupled to one of the frame 17 and the plate 18.

When a single shelf holder 5 fixes a single shelf 6, the single shelf holder 5 may be longitudinally disposed in the main body 3, particularly, in the inner case 2. Also, the single shelf 6 may be selectively fixed to the plurality of coupling holes 31, 32, 33, 34 and 35 of the shelf holder 5.

When a single shelf holder 5 fixes a plurality of shelves 6, the single shelf holder 5 may be longitudinally disposed in the main body 3, particularly, in the inner case 2. Also, the plurality of shelves 6 may be fixed to different coupling holes 31, 32, 33, 34 and 35 of the shelf holder 5, having different heights from each other.

When a plurality of shelf holders 5 together fix a single shelf 6, the plurality of shelf holders 5 may be longitudinally disposed spaced from each other in the main body 3, particularly, in the inner case 2. Also, a plurality of fixing pins 20 may be disposed on the single shelf 6.

A first fixing pin of the plurality of fixing pins 20 may be inserted into one of the plurality of coupling holes 31, 32, 33, 34 and 35 of one shelf holder 5, and a second fixing pin of the plurality of fixing pins 20 may be inserted into one of the plurality of coupling holes 31, 32, 33, 34 and 35 of another shelf holder 5. One shelf 6 may be fixed by the plurality of shelf holder 5.

When a plurality of shelf holders 5 together fix a plurality of shelves 6, the plurality of shelf holders 5 may be longitudinally disposed spaced from each other in the main body 3, particularly, in the inner case 2. Also, a plurality of fixing pins 20 may be disposed on the plurality of shelves 6, respectively. In this case, like a case where one shelf 6 is fixed to the plurality of shelf holders 5, the plurality of shelves 6 may be fixed to the plurality of shelf holders 5, respectively. In this case, the plurality of shelves 6 may be fixed to the plurality of shelf holders 5, having different heights from each other.

More specifically, three shelf holders 5 may be disposed in the main body 3, particularly, in the inner case 2, and two shelves 6 may be height-adjustably disposed on the three shelf holders 5. Each of a left shelf holder, a right shelf holder, and a central shelf holder may be longitudinally disposed in the main body 3, particularly, in the inner case 2 to be spaced from each other in left and right directions. A shelf located at an upper side and a shelf located at a lower side may be vertically spaced from each other in the storage compartment 1, and each of the shelves may be disposed in a horizontal direction.

A light-guiding member 40 may be disposed in the shelf 6.

The light-guiding member 40 may be disposed on at least one end of the shelf 6.

For example, the light-guiding member 40 may be disposed to surround at least a portion of the edge of the shelf 6. Specifically, the light-guiding member 40 may be disposed on a surface (front side) of the edge of the shelf 6, which faces the door 4. FIG. 2 illustrates that the light-guiding member 40 is located at the front side of the shelf 6, but the present invention is not limited thereto. For example, the light-guiding member 40 may also be disposed on a portion or all regions of the edge of the shelf 6.

More specifically, the light-guiding member 40 may be longitudinally disposed in left and right directions on one end (surface exposed to the front side) of the shelf 6. The light-guiding member 40 may be formed to have a rod shape. The light-guiding member 40 may be fixed to one end (surface exposed to the front side) of the shelf 6 by an adhesive material such as an adhesive.

A front decoration 48 may be disposed on the light-guiding member 40. The front decoration 48 may be formed to be transparent or semitransparent such that the light-guiding member 40 can be seen from the outside or light of the light-guiding member 40 can be transmitted. The front decoration 48 may be formed of a material having a high light transmittance.

The front decoration 48 may be disposed on a surface (front side) of the light-guiding member 40, which faces the door 4. The front decoration 48 may be disposed on one end (front side) of the light-guiding member 40. The front decoration 48 may be longitudinally disposed on one end of the light-guiding member 40 in left and right directions. The front decoration 48 may be fixed to the light-guiding member 40 by an adhesive material such as an adhesive or an adhesion member such as a tape.

The light-guiding member 40 may be a Light Guide Plate (LGP) that guides light irradiated from the light source unit 8. Light irradiated from the light source unit 8 may be evenly dispersed to the front side of the light-guiding member 40.

The light-guiding member 40 may include a scattering agent 42 that diffusedly reflects light on the surface facing the shelf 8. As the light member 40 gets closer to the light source unit 8, the amount of the scattering agent 42 may decrease. On the contrary, as the light member 40 gets farther from the light source unit 8, the amount of the scattering agent 43 may increase. The scattering agent 42 may be evenly distributed on the rear surface of the light-guiding member 40. The scattering agent 42 may be formed to be recessed or protruded from the rear surface of the light-guiding member 40.

Light irradiated from the light source unit 8 may be evenly reflected to the front direction of the light-guiding member 40. A diffused reflection pattern that is the scattering agent 42 may be formed in the rear surface of the light-guiding member 40. The light-guiding member 40 may be formed of an acrylic material, and an ink for the diffused reflection may be printed in the diffused reflection pattern or a V-shaped groove may be formed in the diffused reflection pattern. The V-shaped groove may be formed in the rear surface of the light-guiding member 40 at a uniform interval.

A decoration pattern 44 may be formed at the front surface of the light-guiding member 40. The decoration pattern 44 may be formed on the front surface of the light-guiding pattern 40 such that a protruding portion and a recessed portion are repeated to form an unevenness shape. Light guided by the light-guiding unit 40 may be brightly seen at the decoration pattern 44. The light-guiding member 40 may be protected by the front decoration 48 and the shelf 6 between the front decoration 48 and the shelf 6.

The light source unit 8 may be disposed in the storage compartment 1 to irradiate light to the storage compartment 1.

The light source unit 8 may be disposed in the inner case 2, and may allow a user to easily find food by brightly illuminating the storage compartment 1. The light source unit 8 may be turned on when the door 4 is opened.

The light source unit 8 may be located such that a portion of light generated in the light source unit 8 enters the light-guiding member 40.

For example, the light source unit 8 may be disposed on one surface of the inner case 2 so as to face at least one region of the light-guiding member 40.

Specifically, the light source unit 8 may be disposed on one surface of the inner case 2 perpendicular to the shelf 8.

More specifically, the light source unit 8 may be disposed on one of left and right side plates 21 and 22 of the inner case 2 such that one region A of the light unit 8 faces the light-guiding member 40. The light source unit 8 may function as a light source that illuminates the light-guiding member by irradiating light to the light-guiding member 40.

When the shelf 6 is mounted on the shelf holder 5, the light source unit 8 may include a first region A that faces the light-guiding member 40 and a second region B that does not face the light-guiding member 40.

Also, a light entrance part 41 which light enters may be disposed at one end or both ends of the light-guiding member 40, and the light source unit 8 may be disposed adjacent to the light entrance part 41.

The light source unit 8 may be disposed in plurality at left side and right side across the light-guiding member 40, respectively. The light source unit 8 may be longitudinally disposed at the left and right side plates 21 and 22 of the inner case 2 in a vertical direction, respectively.

The light source unit 8 may include a left light source unit longitudinally disposed at the left side plate 21 of the inner case 2 in a vertical direction and a right light source unit longitudinally disposed at the right side plate 22 of the inner case 2 in a vertical direction.

The left light source unit may irradiate light to the light-guiding member 40 from the left side of the light-guiding member 40, and the right source unit may irradiate light to the light-guiding member 40 from the right side of the light-guiding member 40.

The light source unit 8 may include the left light source unit and the right source unit such that light can be evenly dispersed to the whole of the light-guiding member 40. The light-guiding member 40 may reflect both light irradiated from the left light source unit and the right light source unit to the front side between the left light source unit and the right source unit.

The light source unit 8 may be implemented using a Light Emitting Diode (LED) module in consideration of the safety, the compactification, and the heat-generating characteristics. The LED module may include a substrate and an LED installed on the substrate.

Light irradiated from the light source unit 8 may illuminate the storage compartment 1, and a portion of light may be irradiated to the light-guiding member 40 to illuminate the light-guiding member 40. That is, the light source unit 8 and the light-guiding member 40 may together function as a shelf light source unit. When the light-guiding member 40 is not installed at one end of the shelf 6, the front side of the shelf 6 may not be illuminated as a whole even when the light source unit 8 is turned on. On the other hand, when the light-guiding member 40 is not installed at one end of the shelf 6, the front side of the shelf 6 may be illuminated as a whole when the light source unit 8 is turned on. When the whole of the light source unit 8 is located not to face the light-guiding member 40, the amount of light incident into the light-guiding member 40 may be small.

On the contrary, when a portion of the light source unit 8 is located to face the light-guiding member 40, the amount of light incident into the light-guiding member 40 may be large, and the illumination effect may be maximized by the light-guiding member 40. The light source unit 8 may irradiate light to the light-guiding member 40 at a location closer to the light-guiding member 40. Since the mounting height of the shelf 6 can vary, the light source unit 8 may be disposed so as to illuminate the whole region where the shelf 6 can be installed. The height of the top of the light-guiding unit 8 may be equal to or higher than that of an uppermost coupling hole of the shelf holder 5, and the height of the bottom of the light-guiding unit 8 may be equal to or lower than that of a lowermost coupling hole of the shelf holder 5.

When the light source unit 8 is disposed on one of an upper plate 23, a lower plate, and a rear plate 35 of the inner case 2, a distance between the light source unit 8 and the light-guiding member 40 may be too far to maximize the illumination effect of the light-guiding member 40.

The light source unit 8 may be disposed at the left and right side plates 21 and 22 of the inner case 2, respectively.

The light source unit 8 may be turned on when the door 4 is opened, and the light source unit 8 may be turned off when the door 4 is closed. The door sensor may sense whether the door 4 is opened or closed, and may send the sensing result to a controller disposed in the refrigerator. When the door sensor senses that the door 4 is opened, the controller may turn on the light source unit 8, and when the door sensor senses that the door 4 is closed, the controller may turn off the light source unit 8.

Figure 5:
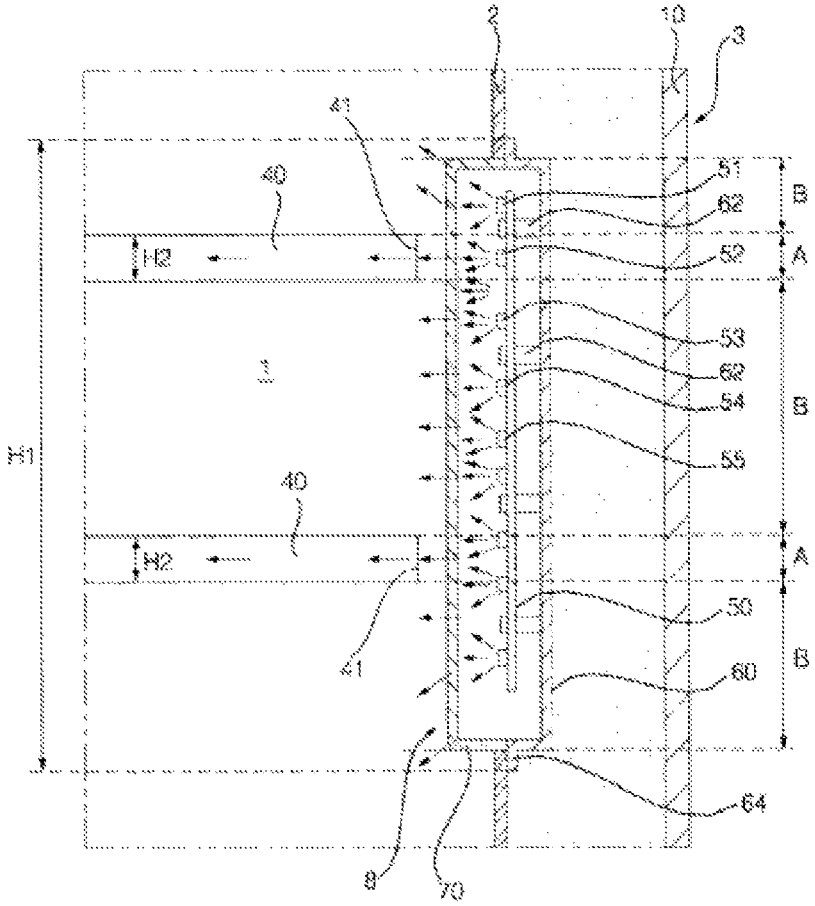
FIG. 5 is a longitudinally-sectional view illustrating an exemplary refrigerator according to an embodiment of the present invention.
Figure 6:
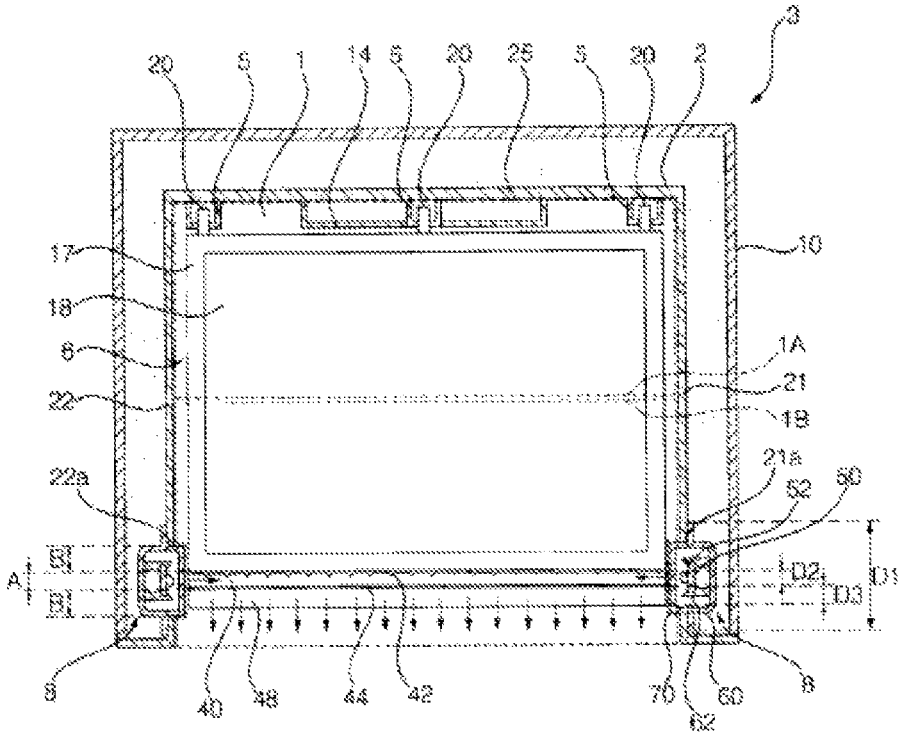
FIG. 6 is a cross-sectional view illustrating an exemplary refrigerator according to an embodiment of the present invention.
Figure 7:
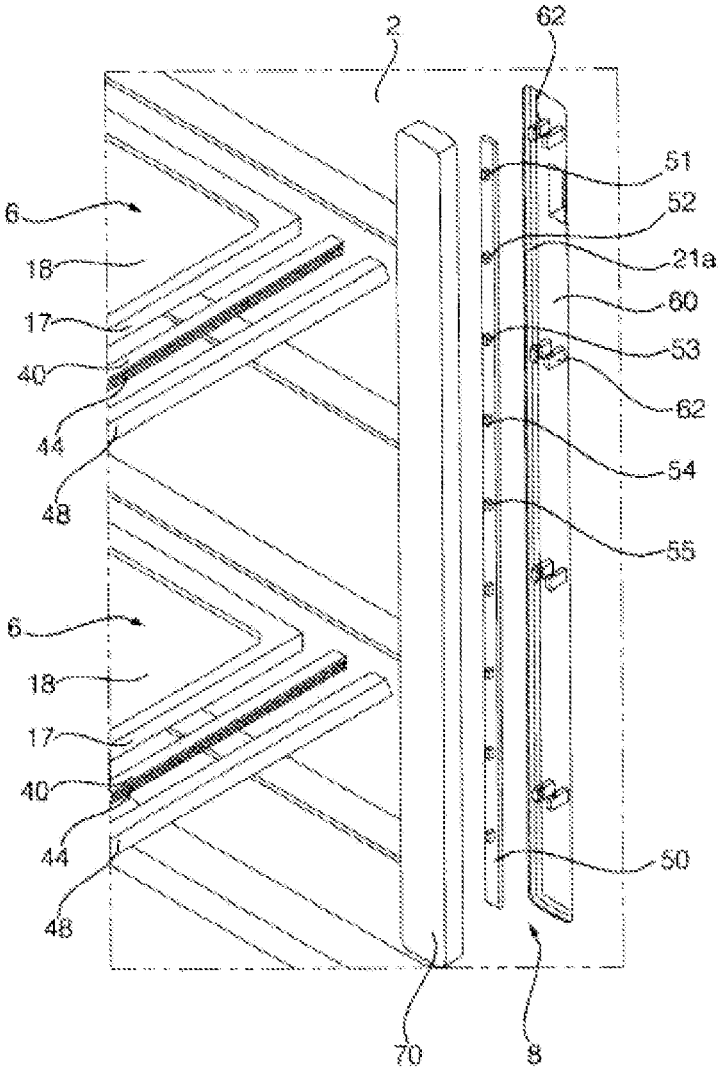
FIG. 7 is an exploded perspective view illustrating a main part of an exemplary refrigerator according to an embodiment of the present invention.

FIG. 5 is a longitudinally-sectional view illustrating an exemplary refrigerator according to an embodiment of the present invention. FIG. 6 is a cross-sectional view illustrating an exemplary refrigerator according to an embodiment of the present invention. FIG. 7 is an exploded perspective view illustrating a main part of an exemplary refrigerator according to an embodiment of the present invention.

The storage compartment 1 may be divided into an internal rear space 1A and an internal front space 1B. One end of the shelf 6 may be located at the internal front space 1B.

The light-guiding member 40 may be located at the internal front space 2B of the storage compartment 1. The light-guiding member 40 may be spaced from the light source unit 8 in left and right directions.

The whole height H1 of the light source unit 8 may be greater than the whole height H2 of the light-guiding member 40.

The light source unit 8 may include a substrate 50 and a plurality of LEDs 51, 52, 53, 54 and 55 installed on the substrate 50 at different heights. The number of LEDs 51, 52, 53, 54 and 55 may be larger than the number of the light-guiding member 40.

The light source unit 8 may include an illumination case 60 disposed at the substrate 50. The light source unit 8 may include an illumination cover 70 that can protect the substrate 50 and the LEDs 51, 52, 53, 54 and 55.

The substrate 50 may be disposed in singularity or plurality at the illumination case 60. A single substrate 50 may be longitudinally disposed in a vertical direction. The substrate 50 may be disposed in plurality at the illumination case 60 to be spaced from each other in a vertical direction.

The plurality of LEDs 51, 52, 53, 54 and 55 may protrude from the substrate 50 in a lateral direction. The plurality of LEDs 51, 52, 53, 54 and 55 may be spaced from each other in a vertical direction. When the shelf 6 is fixed to the shelf holder 5, at least one of the plurality of LEDs 51, 52, 53, 54 and 55 may be disposed adjacent to the light-guiding member 40 in a vertical direction. Even when the shelf 5 is fixed to one of the plurality of coupling holes 31, 32, 33, 34 and 35 of the shelf holder 5, at least one of the plurality of LEDs 51, 52, 53, 54 and 55 may be disposed to face the light-guiding member 40 at the same height as the light-guiding member 40. The number of the plurality of LEDs 51, 52, 53, 54 and 55 may be equal to or larger than the number of the coupling holes 31, 32, 33, 34 and 35 of the shelf holder 5.

At least one of the plurality of LEDs 51, 52, 53, 54 and 55 may be disposed at the same height as the coupling holes 31, 32, 33, 34 and 35 of the shelf holder 5, respectively. A portion 52 of the plurality of LEDs 51, 52, 53, 54 and 55 may illuminate the light-guiding member 40 at the same height as the light-guiding member 40, and others 51, 53, 54 and 55 may illuminate the storage compartment 1 at heights different from the light-guiding member 40.

The light source unit 8 may be disposed in the inner case 2. The inner case 2 may have openings 21 a and 22*a* disposed at the left and right side plates 21 and 22, respectively. The left light source unit may be disposed to penetrate the opening 21*a* formed in the left side plate 21 of the inner case 2. The right light source unit may be disposed to penetrate the opening 22*a* formed in the right side plate 22 of the inner case 2.

The illumination case 60 may define the exterior of the light source unit 8 together with an illumination cover 70. The illumination case 60 may be disposed between the inner case 2 and the outer case 10. The illumination case 60 may include a substrate holder 62. The substrate holder 62 may protrude from the illumination case 60. The substrate holder 62 may be disposed in plurality to be spaced from each other in a vertical direction. The illumination case 60 may have one side thereof opened. A contact part 64 that contacts the outer surface of the inner case 2 may be provided to the illumination case 60.

The illumination cover 70 may be coupled to at least one of the illumination case 60 and the inner case 2. The illumination cover 70 may be formed to have a right side surface opened when the left side surface of the illumination case 60 is opened, and may be formed to have a left side surface opened when the right side surface of the illumination case 60 is opened. The illumination cover 70 may be formed of a transparent or semitransparent material. The illumination cover 70 may include an optical diffusion part on the inner side surface thereof. The illumination cover 70 may disposed to cover the openings 21 a and 22*a* of the inner case 2. The illumination cover 70 of the left light source unit may be disposed to cover the opening 21*a* formed in the left side plate 21 of the inner case 2. The illumination cover 70 of the right light source unit may be disposed to cover the opening 22*a* formed in the left side plate 22 of the inner case 2. The illumination cover 70 may have at least a portion thereof protruding to the storage compartment 1 compared to the inner surface of the inner case 2. The illumination cover 70 may be disposed to be exposed to the storage compartment 1. A portion of a storage compartment directing surface of the illumination cover 70 which faces the light-guiding member 40 in a horizontal direction may become a first region A, and the other portion thereof which does not face the light-guiding member 40 in a horizontal direction may become a second region B.

The width D1 of the light source unit 8 in forward and backward directions may be greater than the width D2 of the light-guiding member 40 in forward and backward directions. Light irradiated from the light source unit 8 may be incident into the light-guiding member 40 through the whole of the side surface of the light-guiding member 40.

The width D1 of the light source unit 8 in forward and backward directions may be greater than the sum (D2+D3) of the width D2 of the light-guiding member 40 in forward and backward directions and the width D3 of the front decoration 48 in forward and backward directions.

Light irradiated from the light source unit 8 may be incident into the light-guiding member 40 through the whole of the side surface of the light-guiding member 40, and may be incident into the front decoration 48 through the whole of the side surface of the front decoration 48.

Accordingly, the size and the material cost of the light-guiding member 40 can be minimized, and the structure of the shelf 6 can be simplified.

Also, since the light source unit 8 irradiates light to both of the light-guiding member 40 and the storage compartment 1, it is unnecessary to install a separate light source unit 8 for illuminating the light-guiding member 40, and thus the structure thereof can be simplified.

Also, light irradiated from the left side of the light-guiding member 40 and light irradiated from the right side of the light-guiding member 40 may allow the whole of the light-guiding member 40 to be evenly brightened.

Also, even when the arrangement height of the shelf 6 varies, the light source unit 8 can irradiate light to the light-guiding member 40.

Also, light reflected from the light-guiding member 40 to the front side thereof may be concentrated on the decoration pattern, and thus the front surface of the light-guiding member 40 can be further brightened and the internal decoration beauty of the storage compartment 1 can be enhanced.

Also, the light-guiding member 40 can be protected by the front decoration 48 and the shelf 8, and thus the reliability can be improved.

Also, light irradiated from the light source unit 8 can be irradiated through the front decoration 48, and thus the light source unit 8 can illuminate a broader area.

Figure 8:
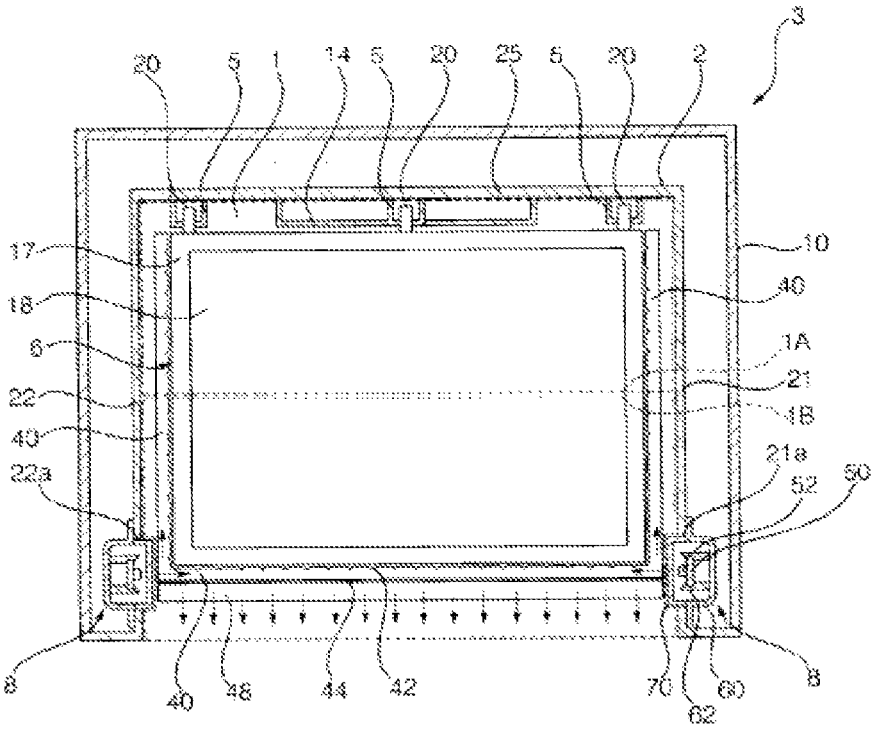
FIG. 8 is a cross-sectional view illustrating a refrigerator according to another embodiment of the present invention.

FIG. 8 is a cross-sectional view illustrating a refrigerator according to another embodiment of the present invention.

Referring to FIG. 8, the refrigerator according to another embodiment differs from the refrigerator of FIG. 6 in the arrangement of the light-guiding 40.

The light-guiding member 40 may be disposed to surround the front side and lateral side of the edge of the shelf 6.

Accordingly, light generated in a light source unit 8 may be diffused into the whole of the shelf 6 by the light-guiding member 40, and thus the internal esthetic sense of a storage compartment 1 can be improved, and the storage compartment 1 can be prevented from being shadowed by containers stored in the storage compartment 1.

The actions of the present invention configured as above will be described as follows.

First, when the door 4 is opened, the light source unit 8 may be turned on. Light irradiated from the light source unit 8 may be diffused into the light-guiding member 40 and the storage compartment 1.

Light irradiated from the first region A of the light source unit 8 to the light-guiding member 40 may brightly illuminate the light-guiding member 40, and may be widely dispersed to the front side of the light-guiding member 40. The dispersed light to the front side of the light-guiding member 40 can be recognized from the outside through the front decoration, and the surroundings of the light-guiding member 40 of the refrigerator can be brightly viewed as a whole. Light dispersed through the light-guiding member 40 may brightly illuminate the front side of the shelf 6, and may allow the inside of the storage compartment 2 to look wider.

Meanwhile, light irradiated from the second region B of the light source unit 8 to the storage compartment 1 may brightly illuminate an upper region and a lower region of the light-guiding member 40.

The internal front space 1B of the storage compartment 1 of the refrigerator can be illuminated as a whole, and particularly, the front side of the shelf 6 can be more brightly illuminated.

On the other hand, when a user closes the door 4, the light source unit 8 may be turned off.

The invention claimed is:

1. A refrigerator comprising:

a main body comprising a storage compartment;

a door opening and closing the storage compartment;

a shelf detachably coupled to the storage compartment to partition the storage compartment into a plurality of spaces;

a light source unit illuminating the storage compartment; and a light-guiding member disposed on at least one end of the shelf, wherein the light source unit is disposed such that a portion of light generated in the light source unit enters the light-guiding member, wherein the storage compartment is divided into an internal rear space and an internal front space in which one end of the shelf is disposed, and the light-guiding member is disposed in the internal front space of the storage compartment, wherein the main body comprises an inner case defining the storage compartment, and the light source unit is disposed on one surface of the inner case so as to face at least one region of the light-guiding member, and wherein the shelf is horizontally disposed in the storage compartment, and the light source unit is disposed on the one surface of the inner case perpendicular to the shelf.

2. The refrigerator of claim 1, wherein the light-guiding member is disposed to surround at least a portion of an edge of the shelf.

3. The refrigerator of claim 2, wherein the light-guiding member comprises a light receiving part for receiving light at one end thereof, and the light source unit is disposed adjacent to the light receiving part.

4. The refrigerator of claim 1, wherein the light-guiding member is disposed at a side of an edge of the shelf which faces the door.

5. The refrigerator of claim 4, further comprising a front decoration at a side of the light-guiding member which faces the door.

6. The refrigerator of claim 5, wherein the light source unit has a width of forward and backward directions greater than a sum of a width of the light-guiding member in forward and backward directions and a width of the front decoration in forward and backward directions.

7. The refrigerator of claim 1, wherein the inner case further comprises a shelf holder to which the shelf is detachably coupled.

8. The refrigerator of claim 1, wherein the light-guiding member is longitudinally disposed at one end of the shelf in left and right directions, and the light source unit is longitudinally disposed at left and right side plates of the inner case in a vertical direction, respectively.

9. The refrigerator of claim 1, wherein the light source unit comprises a substrate and a plurality of light emitting diodes disposed at different heights, and the number of light emitting diodes is larger than the number of the light-guiding members.

10. The refrigerator of claim 9, wherein a portion of the plurality of light emitting diodes irradiates light to the light-guiding member at the same height as the light-guiding member, and the other light emitting diodes irradiate light to the storage compartment at heights different from the light-guiding member.

11. The refrigerator of claim 9, wherein the light source unit further comprises an illumination cover that protects the substrate and the light emitting diodes and is exposed to the storage compartment.

12. The refrigerator of claim 11, wherein the illumination cover has at least a portion thereof protruding toward the storage compartment compared to an inner surface of the inner case.

13. The refrigerator of claim 12, wherein the illumination cover comprises a first region that faces the light-guiding member in a horizontal direction and a second region that does not faces the light-guiding member in a horizontal direction.

14. The refrigerator of claim 1, wherein the light source unit is disposed in plurality to be spaced from each other across the light-guiding member.

15. The refrigerator of claim 1, wherein the light-guiding member comprises a scattering agent formed on a rear surface thereof, and comprises a decoration pattern formed on a front surface thereof.

16. A refrigerator comprising:

a main body comprising a storage compartment;

a door opening and closing the storage compartment;

a shelf detachably coupled to the storage compartment to partition the storage compartment into a plurality of spaces;

a light source unit illuminating the storage compartment; and a light-guiding member disposed on at least one end of the shelf, wherein the light source unit is disposed such that a portion of light generated in the light source unit enters the light-guiding member, wherein the storage compartment is divided into an internal rear space and an internal front space in which one end of the shelf is disposed, and the light-guiding member is disposed in the internal front space of the storage compartment, and wherein the light-guiding member comprises a scattering agent formed on a rear surface thereof, and comprises a decoration pattern formed on a front surface thereof.

* * * * *